US007641060B2

(12) United States Patent
Bishop et al.

(10) Patent No.: US 7,641,060 B2
(45) Date of Patent: Jan. 5, 2010

(54) MODULAR, CUSTOMIZABLE WINDOW COVERING HARDWARE SYSTEM

(75) Inventors: Ryan B. Bishop, Jamestown, NC (US); Brande Seth Cross, Greensboro, NC (US); Ashley M. Fortenberry, Charlotte, NC (US)

(73) Assignee: Newell Window Furnishings, Inc., High Point, NC (US)

( * ) Notice: Subject to any disclaimer, the term of this patent is extended or adjusted under 35 U.S.C. 154(b) by 554 days.

(21) Appl. No.: 11/307,085

(22) Filed: Jan. 23, 2006

(65) Prior Publication Data

US 2007/0170134 A1 Jul. 26, 2007

Related U.S. Application Data

(60) Provisional application No. 60/596,441, filed on Sep. 23, 2005.

(51) Int. Cl.
*A47H 1/02* (2006.01)

(52) U.S. Cl. ..... 211/105.1

(58) Field of Classification Search ... 211/105.1–105.6, 211/123; 160/330; 16/93 D, 94 D, 95 D, 16/95 DW, 96 D, 441, 414, 12, 49; D08/378
See application file for complete search history.

(56) References Cited

U.S. PATENT DOCUMENTS

| | | | | |
|---|---|---|---|---|
| 670,789 | A * | 3/1901 | Kroder | 211/105.3 |
| 2,311,838 | A * | 2/1943 | Koch | 428/28 |
| 2,312,185 | A * | 2/1943 | Neunherz | 403/189 |
| 5,642,595 | A * | 7/1997 | Daniels et al. | 52/301 |
| 5,678,703 | A * | 10/1997 | Sawyer | 211/105.1 |

* cited by examiner

*Primary Examiner*—Jennifer E. Novosad
(74) *Attorney, Agent, or Firm*—R. Brian Drozd; Moore & Van Allen, PLLC

(57) ABSTRACT

The window hardware system of the invention comprises a variety of different types of poles in different finishes, colors and styles. A variety of different types of finials are also provided in different colors, materials, styles and shapes. A variety of different types of separate collars are also provided where certain types of collars may match the color, style and finish of the poles. A connection mechanism is provided to connect the finial, collar and pole to one another such that any combination of finial, collar and pole can be assembled. The body of the finial can have a modular construction such that the finial can be assembled from a variety of components to create a custom look.

13 Claims, 4 Drawing Sheets

MODULAR, CUSTOMIZABLE WINDOW COVERING HARDWARE SYSTEM

CROSS-REFERENCE TO RELATED APPLICATIONS

This application claims priority under 35 U.S.C. 119(e) from provisional patent application Ser. No. 60/596,441, filed Sep. 23, 2005, by the inventors hereof, the entire disclosure of which is incorporated herein by reference.

BACKGROUND OF THE INVENTION

The invention relates generally to window hardware and more particularly to a modular, customizable finial system for curtain rods.

It will be appreciated that window coverings such as draperies are commonly suspended from decorative window hardware that comprises a pole and attached finials. Typically, the drapery or other window covering is fit over the pole and the finials are screwed into the ends of the pole. The poles are sold in a variety of colors, finishes and styles and the finials are sold in an even wider variety of styles, shapes colors, styles, finishes and materials. Typically, the finials and poles are sold as a set where the finials match the poles in color, style and finish. While this arrangement is widely employed it does not allow the customer to easily change the look of the window treatments because the customer must buy and install new poles and finials to replace the existing poles and finials.

In attempt to solve this problem it is known to sell the finials separately from the poles where the user can buy different styles of finials that may be attached to the same pole. While this provides greater flexibility in the look of the window hardware it is not a satisfactory result because the finials do not necessarily match the poles. For example a black pole could be fitted with a mother of pearl finial having a brass collar where the different look of the brass trimmed finial mounted on a black pole make the components look as if they do not "go together". As a result consumers that install black poles, for example, would only consider finials that had black collars. The desired flexibility and customization potential is limited because it is not commercially viable to stock finials in all possible combinations of finish, color and style.

Thus, an improved modular window hardware system that allows customization is desired.

SUMMARY OF THE INVENTION

The window hardware system of the invention comprises a variety of different types of poles in different finishes, colors and styles. The poles have a screwthread connection at each end thereof. A wide variety of different types of finials are also provided in different colors, materials, styles and shapes. A variety of different types of separate collars are also provided where certain types of collars may match the color, style and finish of the poles. A connection mechanism is provided to connect the finial, collar and pole to one another such that any combination of finial, collar and pole can be assembled. Because the collars are separate from the finials, any finial can be attached to any pole while achieving an aesthetically pleasing look because the collar can be selected to visually tie the finial and pole together. In another embodiment of the invention, the body of the finial can have a modular construction such that the finial can be assembled from a variety of components to create a custom look.

DETAILED DESCRIPTION OF PREFERRED EMBODIMENTS OF THE INVENTION

Figure 1:
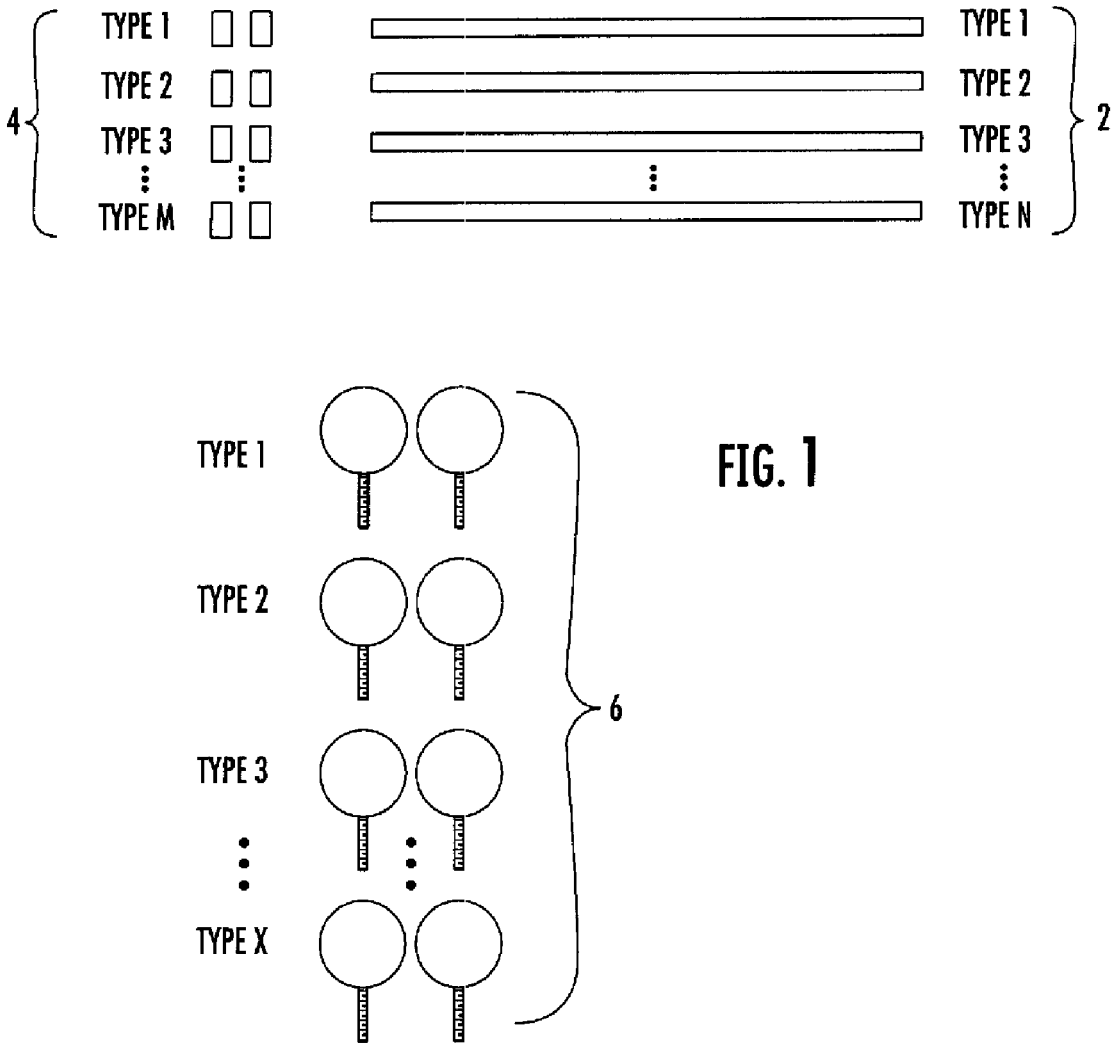
FIG. 1 is a plan view of the components of the modular system of the invention.

Referring to FIG. 1 the hardware system of the invention comprises a variety of different types of poles 2 each of which has a different finish, color, material or the like. A variety of different types of collars 4 are also provided where the collars have different finish, colors material or the like. In one embodiment of the invention, some of the collars 4 have the same finish, color, and material as some of the poles 2 where at least one matching type of collar is provided for each type of pole. Collars that are different from the poles in color, finish or style but that coordinate with the poles are also contemplated. A plurality of different types of finials 6 are also provided where the finials may come in a wide variety of colors, finishes, styles and materials that may be very different than the colors, finishes and materials of the poles 2 and collars 4. To create a complete window hardware assembly, the customer can, for example, purchase a pole of one type and purchase a finial of a second type and a pair of collars of a type that coordinates with the poles and/or finials. The collars 2 and finials 4 are attached to the pole to complete the assembly and provide aesthetically pleasing window hardware.

Figure 2:
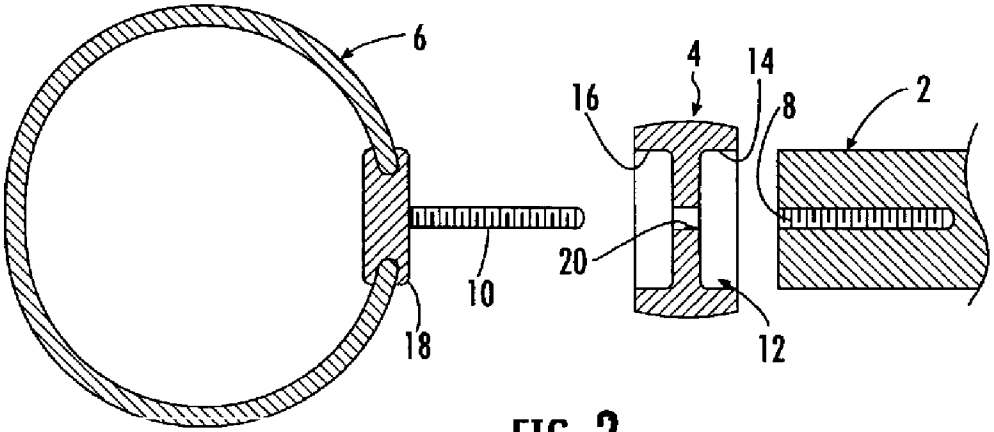
FIG. 2 is a cross-section exploded view of a first embodiment of the window hardware system of the invention.

One embodiment of the window hardware assembly of the invention is shown in FIG. 2 where an end portion of a pole 2 has a threaded bore 8 formed in the end thereof. The finial 6 includes a threaded member 10 extending therefrom where the threaded member mates with the threaded bore 8. The threaded member 10 may be attached to the finial via mounting structure 18 and it may be permanently fixed to the finial or it may be attached such as by a threaded connection. The collar 4 has a through hole 12 formed therein where the through hole 12 has a first large diameter section 14 that fits over the end of the pole 2. The through hole 12 has a second large diameter portion 16 that fits over the threaded member 10 and mounting structure 18 of the finial 6. A small diameter section 20 of through hole 12 connects the first and second large diameter sections to receive threaded member 10 such that the threaded member can extend completely through the collar 4. To assemble the window hardware, the threaded member 10 is inserted through the through hole 12 in the collar 4 and is threadably attached to the threaded bore 8 on pole 2 to trap the collar between the finial and pole. The process is repeated on the opposite end of the pole 2 for the second finial. While the connection between member 10 and bore 8 is described as a threaded connection, it is to be understood that member 10 may be connected in bore 8 by a mechanism other than screwthreads. For example, the member 10 and bore 8 may have a friction fit, or the connection may be made by a mechanical connection such as a snap fit. Moreover, an adhesive may be used if desired. It is also possible to reverse the mating elements such that, for example, threaded member 10 is formed on the end of pole 2 and threaded bore 8 is formed on finial 6.

Figure 3:
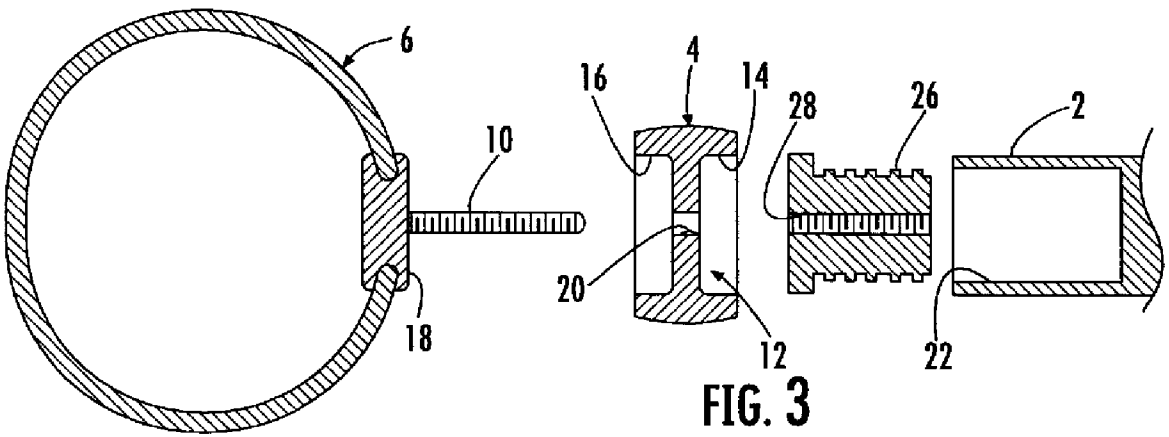
FIG. 3 is a cross-section exploded view of a second embodiment of the window hardware system of the invention.

Another embodiment is shown in FIG. 3 and is similar to the embodiment of FIG. 2 where like reference numerals are used to identify like components. Pole 2 has a large bore 22 formed in the end thereof. A plug 26 having a threaded bore 28 is friction fit into bore 22. Threaded bore 28 threadably receives the threaded member 10 of finial 6 to fix the finial and collar 4 to the pole 2 as previously described. As previously described, it is to be understood that member 10 may be connected in bore 28 by a mechanism other than screwthreads. For example, the member 10 and bore 28 may have a friction fit, or the connection may be made by a mechanical connection such as a snap fit. Moreover, an adhesive may be used if desired. It is also possible to reverse the mating elements such that, for example, threaded member 10 is formed on the end of plug 26 and threaded bore 28 is formed on finial 6.

Figure 4:
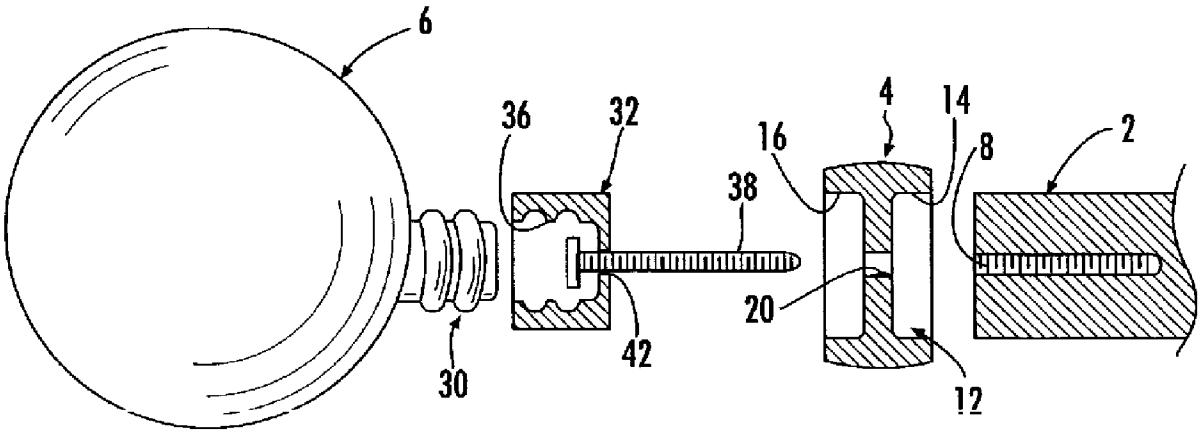
FIG. 4 is a partial cross-section exploded view of a third embodiment of the window hardware system of the invention.

Another embodiment is shown in FIG. 4 where like reference numerals are used to identify like components previously described with reference to FIG. 2. The assembly consists of a finial 6 having a threads 30 formed at one end thereof. An adapter 32 having internal screw threads 36 that threadably engage threads 30 is also provided. A threaded member such as a bolt 38 is disposed in the cavity of adapter 32 formed by internal threads 36 and extends from the adapter via through hole 42. The adapter 32 is screwed to the finial 6 with the threads 30 engaging threads 36 of the adapter. The threaded member 38 is trapped in adapter 32 and extends from the adapter via through hole 42. The finial may be assembled to the pole 2 by screwing threaded member 38 into threaded bore 8 as previously described with reference to FIG. 2. While the connection between finial 6 and pole 2 is described as a threaded connection, it is to be understood that these members may be connected by a mechanism other than screwthreads as previously described.

Figure 5:
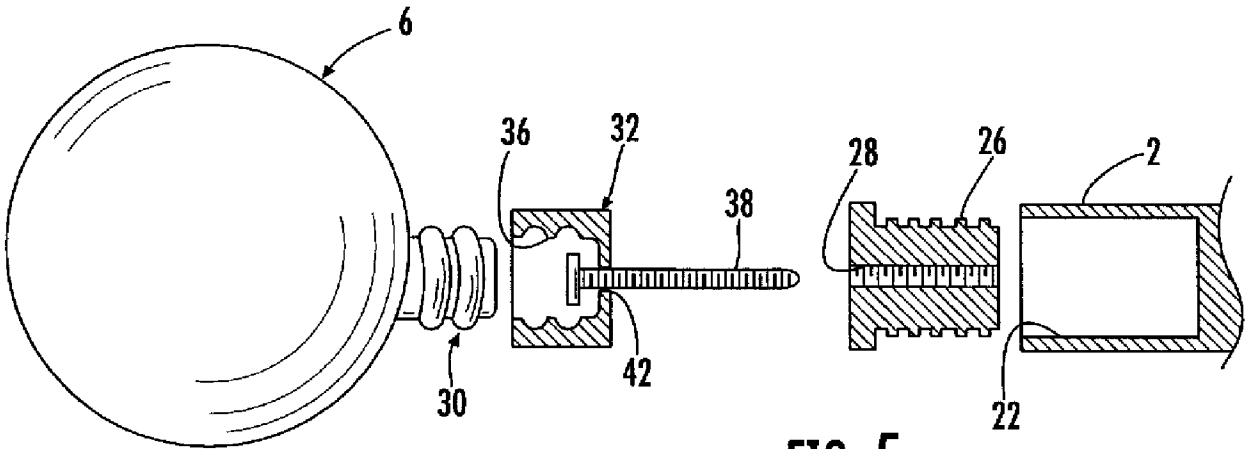
FIG. 5 is a partial cross-section exploded view of a fourth embodiment of the window hardware system of the invention.

Referring to FIG. 5 the assembly is shown using the adapter structure described with reference to FIG. 4 with the plug structure described with reference to FIG. 3 and like numerals are used to identify like components. Again, while the connection between finial 6 and pole 2 is described as a threaded connection, it is to be understood that these members may be connected by a mechanism other than screwthreads as previously described. The adapter structure of FIGS. 4 and 5 is particularly well suited for use with glass finials although it may be used with finials of any material.

The invention has been described where the collars, finials and pole are connected to one another using a connector such as a screw thread to connect the finial to the pole where the collar is trapped between the finial and the pole. It is to be understood that the invention could also use separate connectors on the pole, finial and collars such that the collar is connected directly to the pole and the finial is connected to either the pole as shown in the figures or is connected directly to the collar. Referring to FIG. 1 this arrangement can be effected by forming internal screw threads on the interior of section 14 that mate with external threads formed on pole 2. The finial could then be attached as shown in FIG. 2 where the threaded member engages an interior bore of the pole or the collar could be formed with screw threads that mate with screw threads formed on the finial such as threaded member 10. Moreover, the threaded connections may be replaced by snap fit connections, friction fit connections or other mechanical or adhesive connecting mechanisms.

Figure 6:
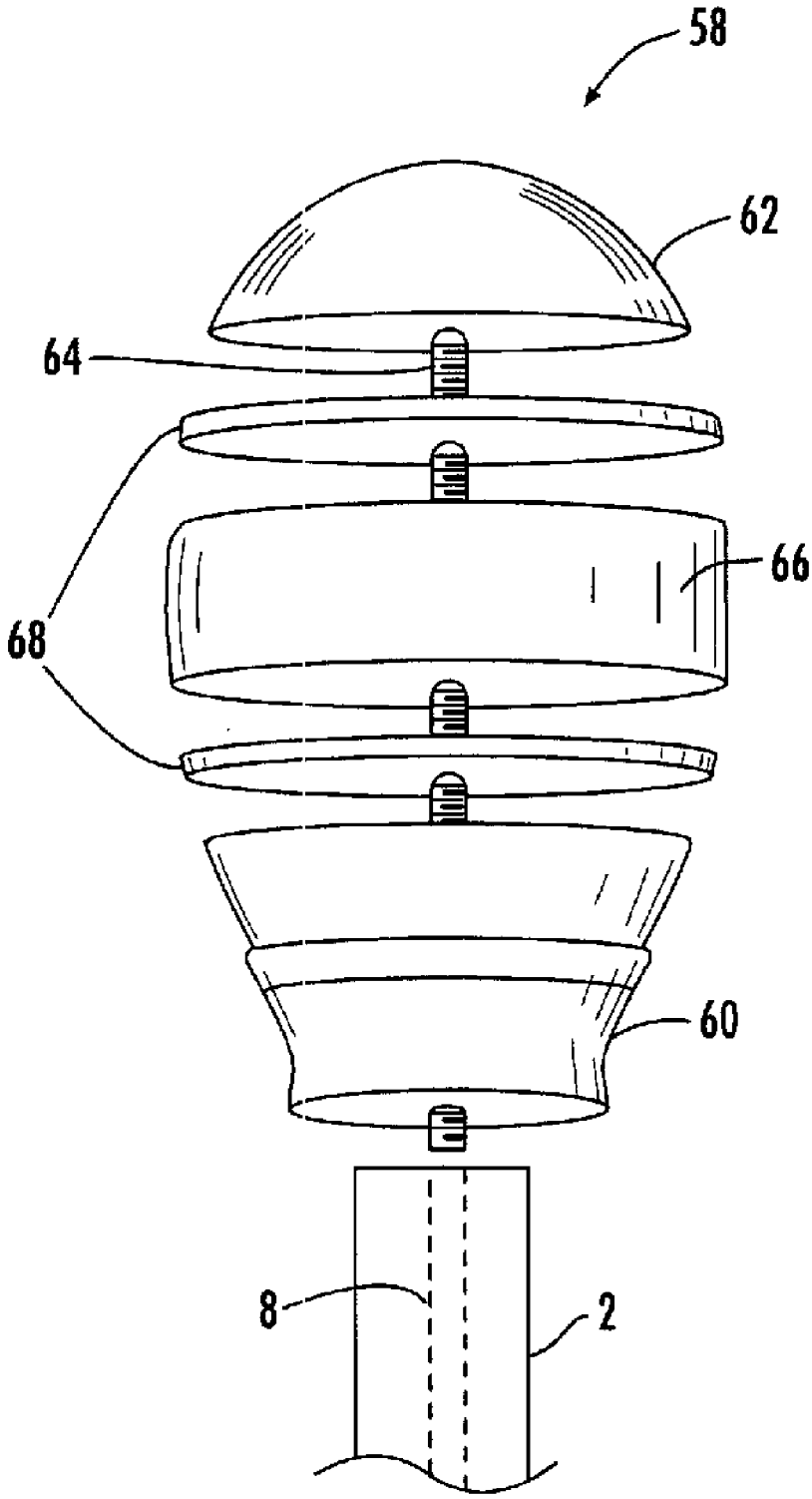
FIG. 6 is an exploded perspective view of a sixth embodiment of the window hardware system of the invention.

Another embodiment of a modular finial is shown at 58 in FIG. 6 and includes a collar portion 60 and a cap portion 62. Cap portion 62 includes a threaded member 64 extending therefrom that is inserted through a through hole formed in collar portion 60 so as to extend therefrom. The cap portion 62 and collar portion 60 may be made of the same material with the same finish, color and style. In one embodiment, the collar portion 60 and cap portion 62 are made to have the same color and finish as the pole 2. Located between the cap portion 62 and collar portion 60 is an insert portion 66 that is made of a material that may be different from the cap portion 62 and collar portion 60 and that has a different finish and/or color. Different insert portions 66 can be purchased and used with different cap portions 62 and collar portions 60 such that an end user can customize the finial. The insert portion 66 is formed with a through hole that receives the threaded member 64 such that the threaded member can extend through the insert portion 66. Located between the cap portion 62 and insert portion 66 and collar portion 60 and insert portion 66 may be disks 68 that form transition areas between the insert portion 66 and the cap portion 62 and collar portion 60. The disks 68 are formed with through holes that receive the threaded member such that the threaded member 64 can extend therethrough. The disks 68 may be constructed of material different from or the same as the material of the cap portion 62, collar portion 60 and/or insert portion 66. While the finial 58 has been described with the threaded member 64 formed as part of the cap portion 62, it is to be understood that the threaded member may be formed as a separate connector that is threaded into a mating threaded bore on the cap portion 62.

While the connection between member 64 and bore 8 is described as a threaded connection, it is to be understood that member 64 may be connected in bore 8 by a mechanism other than screwthreads. For example, the member 64 and bore 8 may have a friction fit, or the connection may be made by a mechanical connection such as a snap fit. Moreover, an adhesive may be used if desired. It is also possible to reverse the mating elements such that, for example, threaded member 64 is formed on the end of pole 2 and threaded bore 8 is formed on finial cap 62. It is also possible to use the plug as shown in FIGS. 3 and 5 with the modular finial shown in FIG. 6.

The invention has been described where the collar portion 60, cap portion 62, insert portion 66 and disks 68 are connected to one another and to pole 2 using a connector such as a screw thread to connect the cap portion 62 finial to the pole 2 where the other components are trapped between the cap portion and the pole. It is to be understood that the invention could also use separate connectors on the pole, cap portion, collar portion, insert portion and disks such that these elements are connected directly to one another. This arrangement can be effected by forming mating screw threads, snap fit or friction fit connectors, adhesive or other securement mechanisms on the facing surfaces of the components. The cap portion 62 would then be directly attached to the adjacent component such as disk 68 or insert portion 66 if no disk is used. The disk 68 would be directly attached to the insert portion 66 and so on where the collar portion 60 is directly attached to the pole 2.

To assemble the finial and window hardware of FIG. 6 the consumer purchases separately a rod, a cap portion and collar portion, and an insert portion. The disks may be provided with either the insert portion, collar portion or cap portions, or they may be purchased separately. Moreover the cap portion and collar portion may be purchased separately from one another. If the threaded member 64 is formed as part of the cap portion 62, the threaded member is inserted through the first disk 68, the insert portion 66, the second disk 68 and collar portion 60 and screwed into the threaded bore 8 formed in the pole 2. If the threaded member 64 is a separate component, it is first secured to either the pole 2 or the cap portion 62 and then inserted through the other components. The cap portion 62 is the tightened onto the pole 2 using the threaded member 64 to trap the components between the pole and the cap portion and complete the assembly of the finial. Where separate connectors are used on the facing surfaces of the components, the components would each be directly attached to the adjacent components. The same process is duplicated on the opposite end of the pole to complete the window hardware assembly.

In addition to providing an aesthetically more pleasing window hardware assembly, the modular system of the invention increases the number of options available to the end user and provides a system that allows the window hardware system to match a room interior décor. Because of the cross-functional nature of the components in the system of the invention more choices can be provided to the consumer without increasing the number of stock components as would be required in the existing systems to provide the same number of choices.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

What is claimed is:

1. A window hardware assembly comprising:

a pole comprising a first end and a second end, the pole being adapted to be attached to a surface and for supporting a window covering;

a first member comprising a first finial attached to the first end of the pole;

a second member trapped between the first member and the pole;

a third member comprising a second finial attached to the second end of the pole; and a fourth member trapped between the third member and the pole;

wherein the second member comprises an internal diameter section sized to fit over a portion of the first member wherein the fourth member comprises an internal diameter section sized to fit over a portion of the third member, wherein the second member is sized to fit over a first portion of the pole, and wherein the fourth member is sized to fit over a second portion of the pole.

2. The assembly of claim 1 wherein the second member is a collar.

3. The assembly of claim 1, wherein the pole is of a pole type and the second member is of a second type that matches the pole type.

4. The assembly of claim 3, wherein the pole type defines at least one of a finish, a color, a material, a style and a shape.

5. The assembly of claim 4, wherein the second type matches the at least one of the finish, the color, the material, the style and the shape of the pole type.

6. The assembly of claim 1 wherein the pole is of a pole type and the first member is of a second type that is different than the pole type.

7. The assembly of claim 1 wherein a connector secures the pole to the first member.

8. The assembly of claim 7 wherein the connector is threaded to the pole.

9. The assembly of claim 7 wherein the connector is threaded to the first member.

10. The assembly of claim 1 wherein a plug is inserted in the first end of the pole, said first member being connected to the pole via said plug.

11. The assembly of claim 1 wherein the second member receives the first portion of the pole and the portion of the first member.

12. The assembly of claim 1 further including an adapter connected to the first member.

13. The assembly of claim 12 wherein the adapter supports a connector, said connector connecting said first member to said pole.

* * * * *

UNITED STATES PATENT AND TRADEMARK OFFICE

CERTIFICATE OF CORRECTION

PATENT NO. : 7,641,060 B2
APPLICATION NO. : 11/307085
DATED : January 5, 2010
INVENTOR(S) : Ryan B. Bishop et al.

It is certified that error appears in the above-identified patent and that said Letters Patent is hereby corrected as shown below:

On the Title Page:
Item (75), line 2, please delete "Brande Seth Cross" and replace with "Brandon Seth Cross"

Signed and Sealed this

Sixteenth Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,641,060 B2
APPLICATION NO. : 11/307085
DATED : January 5, 2010
INVENTOR(S) : Bishop et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 847 days.

Signed and Sealed this

Sixteenth Day of November, 2010

David J. Kappos

David J. Kappos
*Director of the United States Patent and Trademark Office*